US007040241B2

(12) United States Patent
Coates

(10) Patent No.: US 7,040,241 B2
(45) Date of Patent: May 9, 2006

(54) REFRACTORY BRICK AND REFRACTORY CONSTRUCTION

(75) Inventor: Stephen Coates, Galena, IL (US)

(73) Assignee: Merkle Engineers, Inc., Galena, IL (US)

( * ) Notice: Subject to any disclaimer, the term of this patent is extended or adjusted under 35 U.S.C. 154(b) by 465 days.

(21) Appl. No.: 10/155,053

(22) Filed: May 24, 2002

(65) Prior Publication Data

US 2003/0217678 A1 Nov. 27, 2003

(51) Int. Cl.

| | |
|---|---|
| ***F23M 5/06*** | (2006.01) |
| ***F23M 5/02*** | (2006.01) |
| ***F27D 1/02*** | (2006.01) |
| ***E04B 1/00*** | (2006.01) |

(52) U.S. Cl. ..... 110/331; 110/338; 110/334; 373/73; 52/747.13

(58) Field of Classification Search ..... 110/334, 110/338, 331, 332, 333, 335, 339, 340, 336; 373/71, 72, 73; 266/283; 52/747.11, 747.12, 52/747.13

See application file for complete search history.

(56) References Cited

U.S. PATENT DOCUMENTS

| | | | | | |
|---|---|---|---|---|---|
| 1,076,240 | A | * | 10/1913 | Schuffenhauer | 110/331 |
| 1,103,448 | A | * | 7/1914 | Stevens | 52/747 |
| 1,285,469 | A | * | 11/1918 | Tilley | 110/331 |
| 2,021,424 | A | * | 11/1935 | McPherson | 263/46 |
| 2,037,289 | A | * | 4/1936 | Tracy | 100/86 |
| 3,029,755 | A | * | 4/1962 | Critchton | 110/99 |
| 3,340,831 | A | * | 9/1967 | Stein et al. | 110/99 |
| 3,621,627 | A | * | 11/1971 | Kramer | 52/608 |
| 4,075,812 | A | * | 2/1978 | Koyama et al. | 52/747 |
| 4,262,467 | A | * | 4/1981 | Faisant et al. | 52/590 |
| 4,505,088 | A | * | 3/1985 | Lippe | 52/747 |
| 4,864,945 | A | * | 9/1989 | Merkle | 110/334 |
| 6,363,677 | B1 | * | 4/2002 | Chen et al. | 52/586.1 |
| 6,427,610 | B1 | * | 8/2002 | Coates et al. | 110/339 |
| 6,508,042 | B1 | * | 1/2003 | Kweon et al. | 52/608 |

FOREIGN PATENT DOCUMENTS

| | | |
|---|---|---|
| BE | 0066566 | * 12/1982 |
| DE | 70 426 C | 8/1893 |
| EP | 0 066 566 A | 12/1982 |
| FR | 1 474 828 A | 8/1987 |
| JP | 07 292366 A | 11/1995 |

* cited by examiner

*Primary Examiner*—Kenneth Rinehart
(74) *Attorney, Agent, or Firm*—Pauley Petersen & Erickson

(57) ABSTRACT

A refractory brick having a plurality of segments positioned along a longitudinal axis of the refractory brick. Each segment has at least two arcuate recesses and at least two arcuate ridges. The recesses of a first segment of the segments are positioned at a radial offset with respect to the recesses of a second segment which is adjacent the first segment. A plurality of refractory bricks are interlocked with respect to each other to form a refractory construction.

24 Claims, 9 Drawing Sheets

REFRACTORY BRICK AND REFRACTORY CONSTRUCTION

BACKGROUND OF THE INVENTION

1. Field of the Invention

This invention relates to a refractory brick having different segments, each with at least three arcuate recesses. A plurality of refractory bricks can be interlocked with respect to each other to form a refractory construction.

2. Description of Related Art

Conventional refractory bricks have overall rectangular or wedge shapes. Different combinations of the rectangular and wedge shapes are assembled with respect to each other to form a refractory construction. Refractory constructions are often used in high-temperature furnaces, process vessels, or other manufacturing equipment that requires refractory materials.

U.S. Pat. No. 4,864,945 discloses a curved nose refractory construction which includes rectangular refractories and wedge shaped refractories. Adjacent refractories each have a tread construction. Two adjacent tread constructions are interlocked with each other. The entire teachings of U.S. Pat. No. 4,864,945 is incorporated into this Specification, by reference to U.S. Pat. No. 4,864,945.

There is a need to reduce manufacturing time necessary to mass produce refractory bricks.

There is also a need for a refractory brick that can be universally employed to build differently shaped refractory constructions, without requiring different shapes and different sizes of refractory bricks.

SUMMARY OF THE INVENTION

It is one object of this invention to provide a refractory brick that has a relatively simple design, that can be easily mass produced.

It is another object of this invention to provide a refractory brick that can be universally used to build many differently sized and shaped refractory constructions.

It is still another object of this invention to provide a refractory construction assembled from refractory bricks of the same size and shape.

It is yet another object of this invention to provide a refractory construction that can be used in a domed structure, such as a vessel head or a dome-shaped furnace structure.

The above and other objects of this invention are accomplished with a refractory brick that has a plurality of segments positioned along a longitudinal axis of the refractory brick. The segments are preferably but not necessarily integrated with respect to each other.

In one embodiment of this invention, each segment has at least three arcuate recesses. Along the longitudinal axis of the refractory brick, two adjacent segments have arcuate recesses which are radially offset with respect to each other. In one embodiment, the radial offset is approximately 60°.

Each recess is preferably oriented concave inward with respect to the longitudinal axis. The arcuate recess is preferably but not necessarily an arc segment of a circle, which has a constant radius along a periphery of the refractory brick.

In one embodiment, each segment has an arcuate ridge between adjacent recesses. Thus, when the segment has three recesses, the segment also has three ridges. Each ridge is preferably oriented concave outward with respect to the longitudinal axis.

In one embodiment of this invention, the refractory has an overall generally circular periphery. Thus, when looking at a top view of the refractory brick according to this invention, the periphery of the refractory brick appears as a circle.

A refractory construction according to this invention includes a plurality of the refractory bricks according to this invention. The refractory construction has at least one course of refractory bricks. Within each course, adjacent refractory bricks are interlocked with respect to each other. A refractory construction according to this invention can include refractory bricks of the same size and shape. Also, a refractory construction according to this invention can be conveniently and efficiently used to form a curved construction, such as within a head of a vessel.

BRIEF DESCRIPTION OF THE DRAWINGS

The above and other objects of this invention can be better understood by reading the Specification in view of the Drawings, wherein.

DESCRIPTION OF PREFERRED EMBODIMENTS

Figure 1:
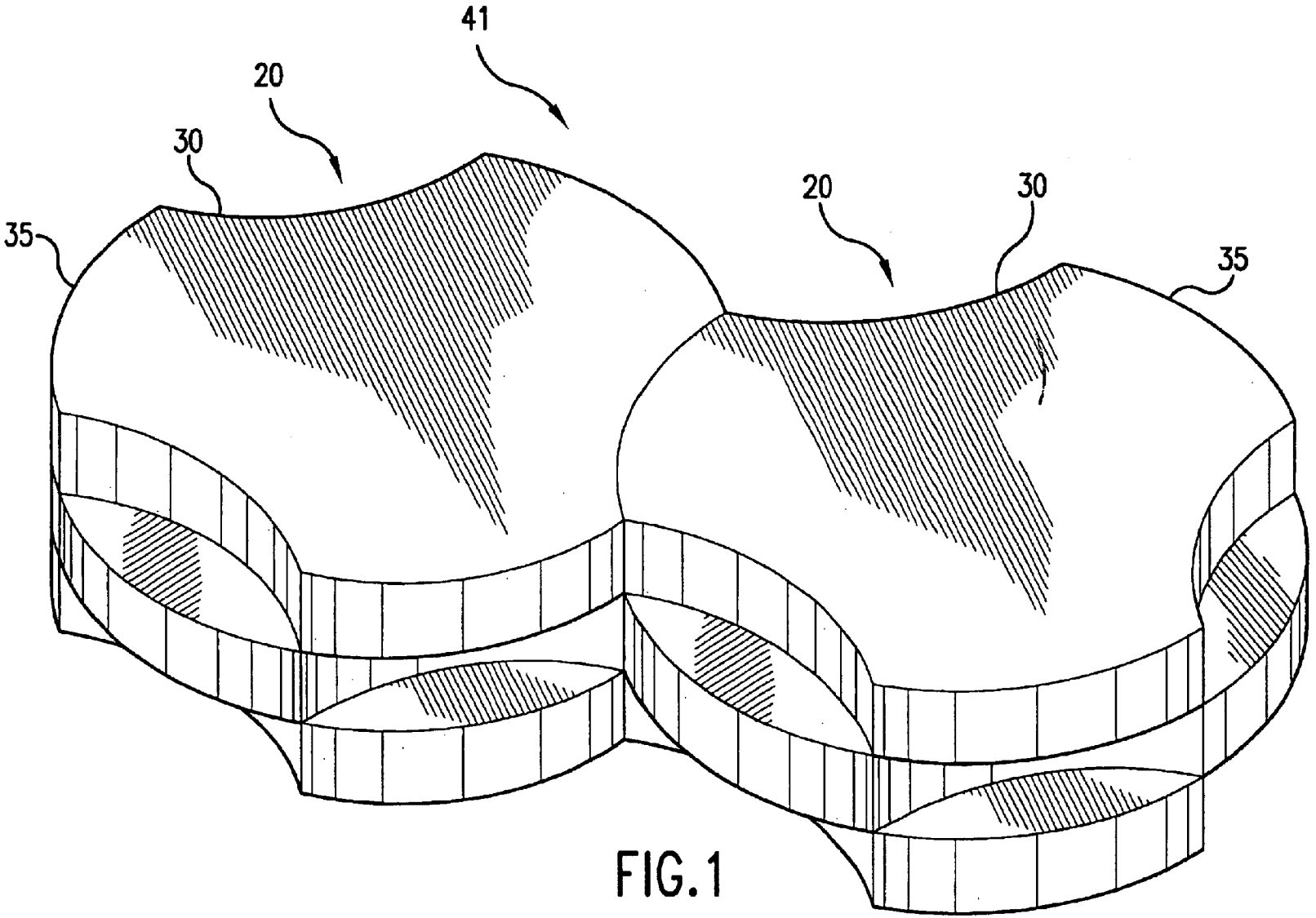
FIG. 1 is a perspective view of two refractory bricks, each having three segments, interlocked with respect to each other, according to one embodiment of this invention.
Figure 2:
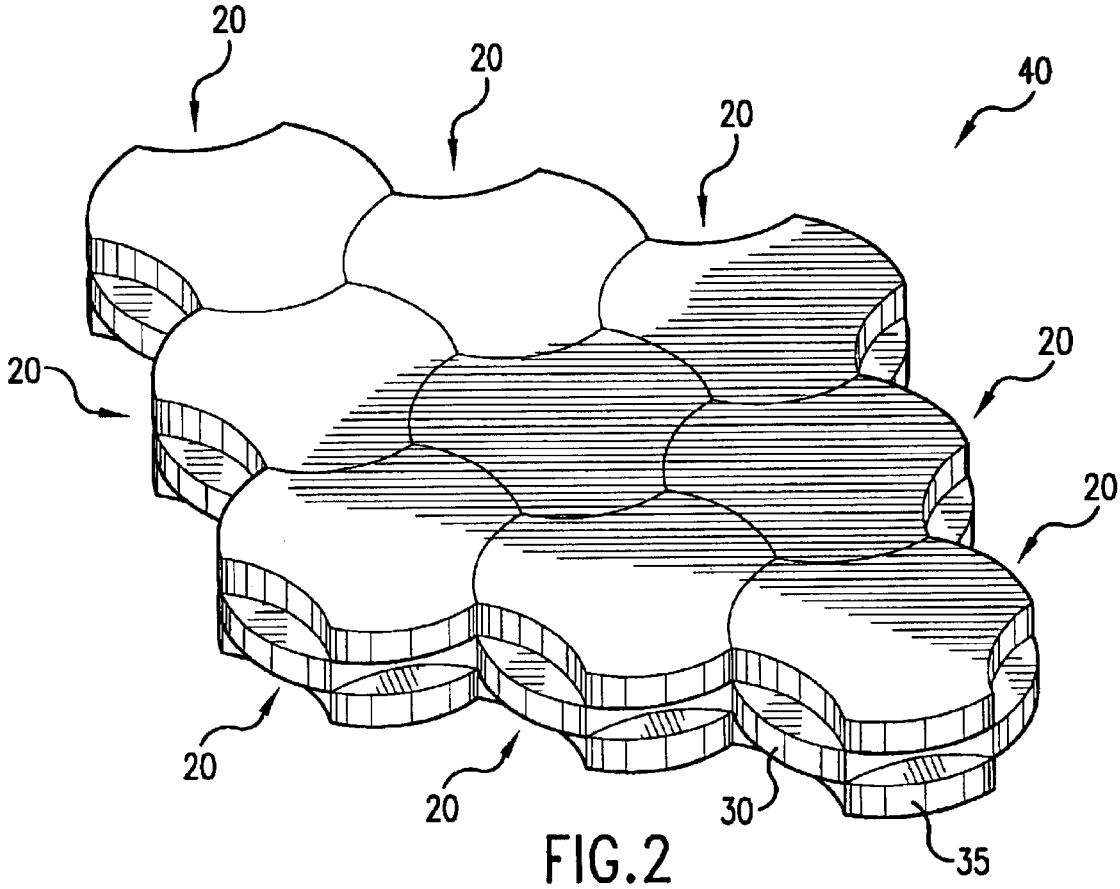
FIG. 2 is a perspective of a refractory construction, showing nine interlocked refractory bricks, each with three segments, according to another embodiment of this invention.
Figure 7:
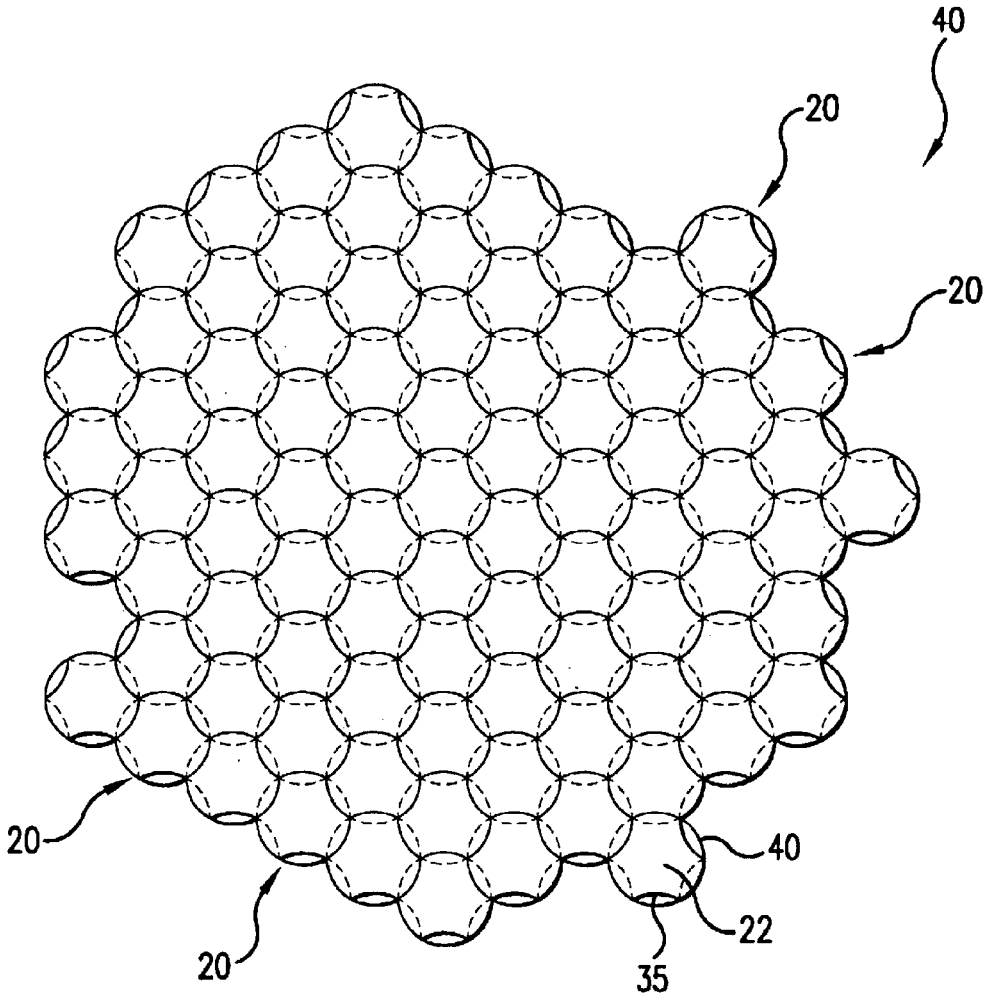
FIG. 7 is a top view of a refractory construction showing multiple refractory bricks interlocked with respect to each other, according to another embodiment of this invention.

FIG. 1 shows two refractory bricks 20 interlocked with respect to each other. FIG. 2 shows a similar perspective view in which nine refractory bricks 20 are interlocked with respect to each other. FIG. 7 shows a top view of a multiplicity of refractory bricks 20 interlocked with respect to each other.

In each of FIGS. 1, 2 and 7, each refractory brick 20 has three segments 25, and each segment 25 has three recesses 30 alternatingly arranged with three ridges 35, according to one embodiment of this invention. With three recesses 30 and three ridges 35, refractory brick 20 is an efficient structure, as later discussed. However, it is apparent that other numbers of recesses 30 and ridges 35 can be used to accomplish similar structural results of this invention.

Figure 4:
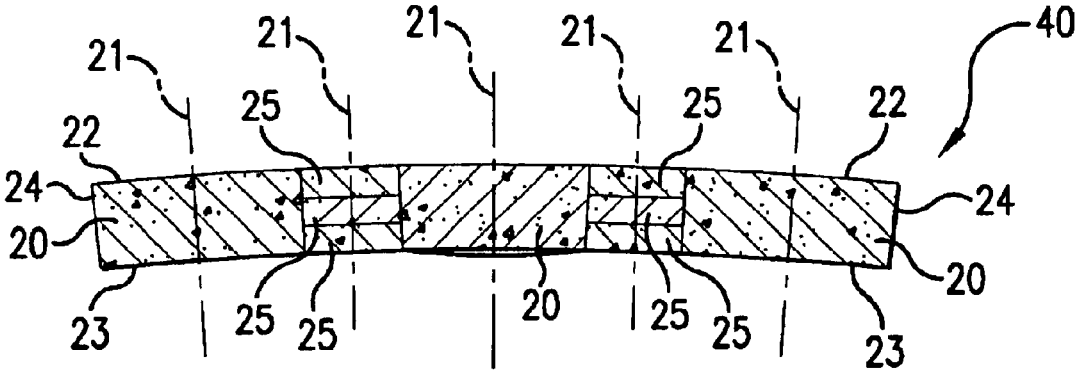
FIG. 4 is a sectional view of the refractory construction, taken along line 4—4, as shown in FIG. 3.
Figure 5:
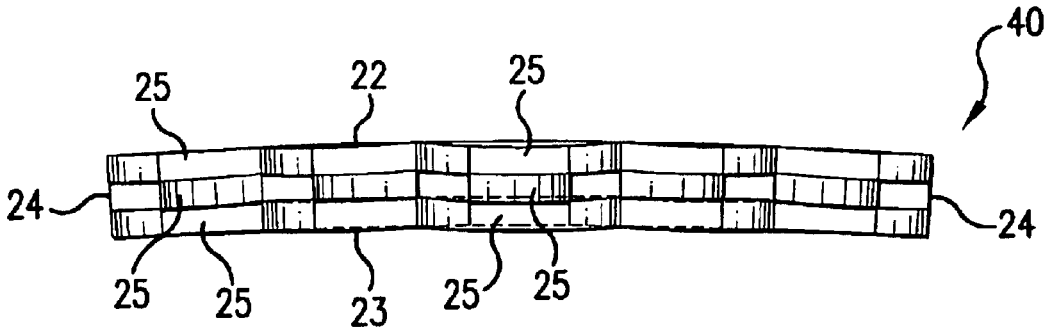
FIG. 5 is a front view of the refractory construction, as shown in FIG. 2.
Figure 6:
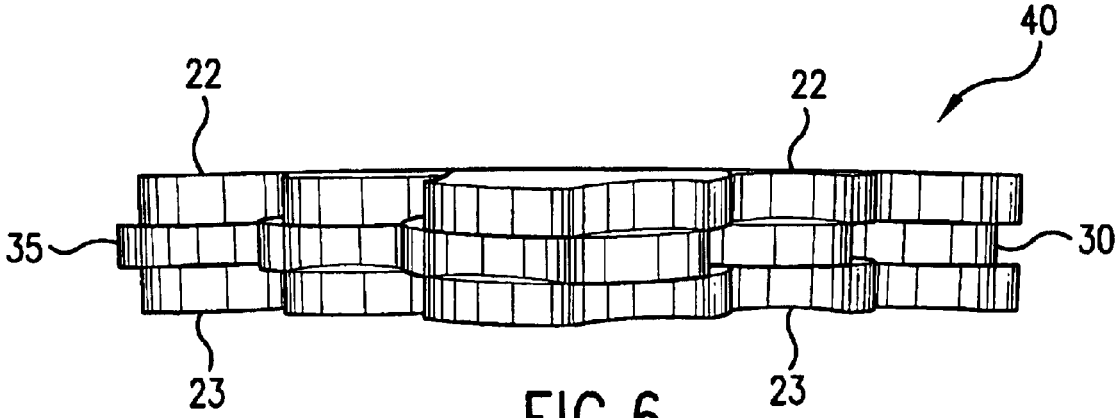
FIG. 6 is a side view of the refractory construction, as shown in FIG. 2.
Figure 10:
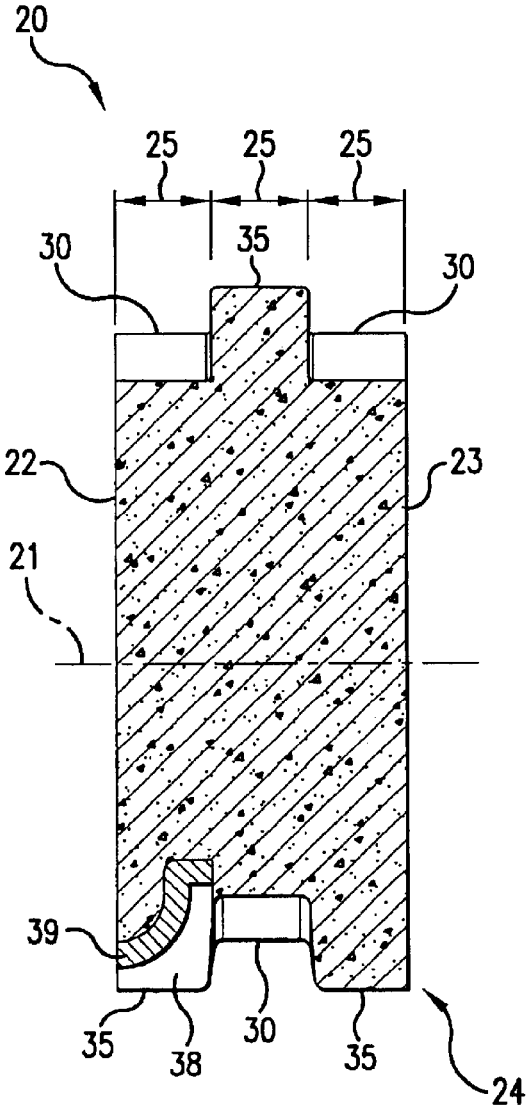
FIG. 10 is a sectional view of the refractory brick, taken along line 10—10, as shown in FIG. 9.
Figure 11:
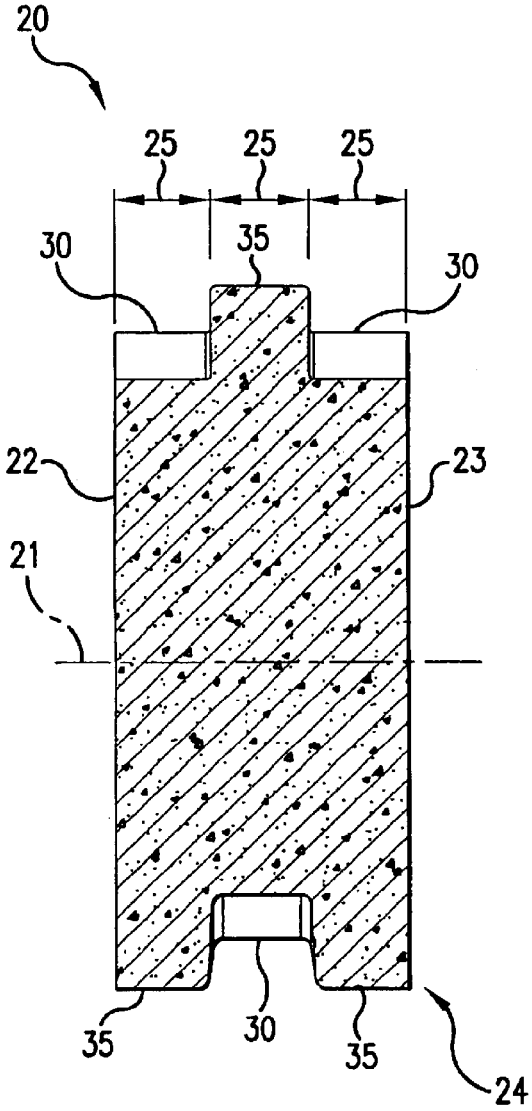
FIG. 11 is a sectional view of the refractory brick, taken along line 11—11, as shown in FIG. 9.

A plurality of segments 25 are positioned along longitudinal axis 21 of refractory brick 20, such as shown in FIGS. 4 and 10. Although FIGS. 4 and 10 show three segments 25 integrated to form a unitary refractory brick 20, it is apparent that one or more segments 25 can be separate from any other segment 25. As shown in FIGS. 4 and 10, segments 25 form a layered structure wherein segments 25 are positioned adjacent to each other. Refractory brick 20 can also comprise two segments 25 or more than three segments 25.

Figure 8:
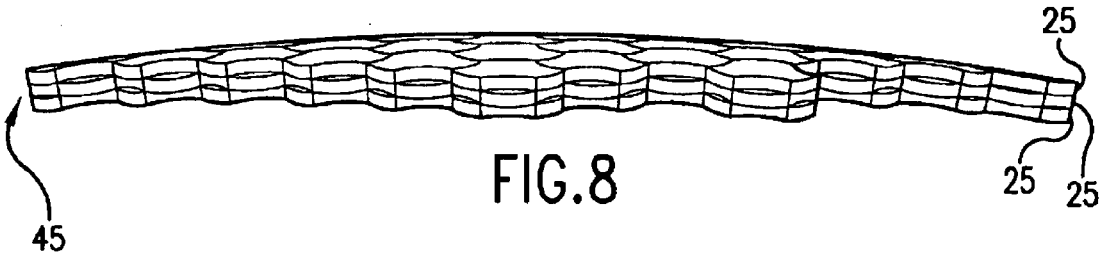
FIG. 8 is a front view of the refractory construction, as shown in FIG. 7.
Figure 9:
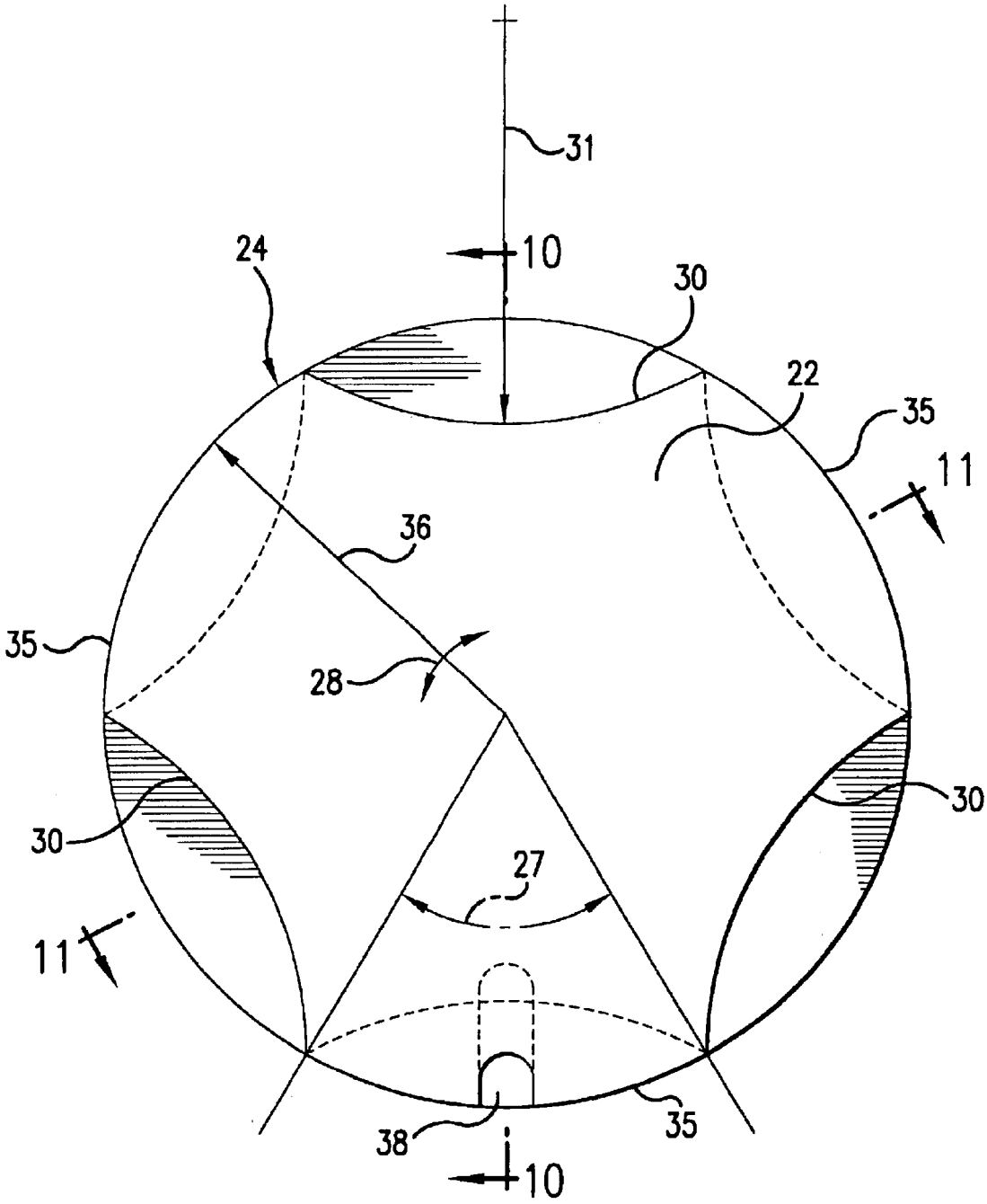
FIG. 9 is a top view of a refractory brick, according to one embodiment of this invention.

Each segment 25 has at least two arcuate recesses 30. As shown in FIGS. 1-11, each segment 25 has three arcuate recesses 30. Regardless of the number, in one embodiment, recesses 30 are evenly spaced in radial direction 28, such as shown in FIG. 9.

In the embodiment shown in FIG. 9, for example, recesses 30 are radially spaced apart by approximately 120°. Also as shown in FIG. 9, radial offset 27 is approximately 60°.

Between two consecutive recesses 30 there is an arcuate ridge 35. Thus, as shown in FIG. 9, each segment 25 has three ridges 35. In preferred embodiments of this invention, within each segment 25, the number of recesses 30 is equal to the number of ridges 35. In certain refractory constructions, for example along a straight wall section of a vessel or a furnace, refractory brick 20 can be cut or shaped to accommodate or better fit the particular design of a structure. If a portion of refractory brick 20 is used, then the number of recesses 30 may not equal the number of ridges 35. As shown in FIGS. 1, 2 and 9-11, recess 30 is concave inward with respect to longitudinal axis 21 and ridge 35 is concave outward with respect to longitudinal axis 21.

Figure 3:
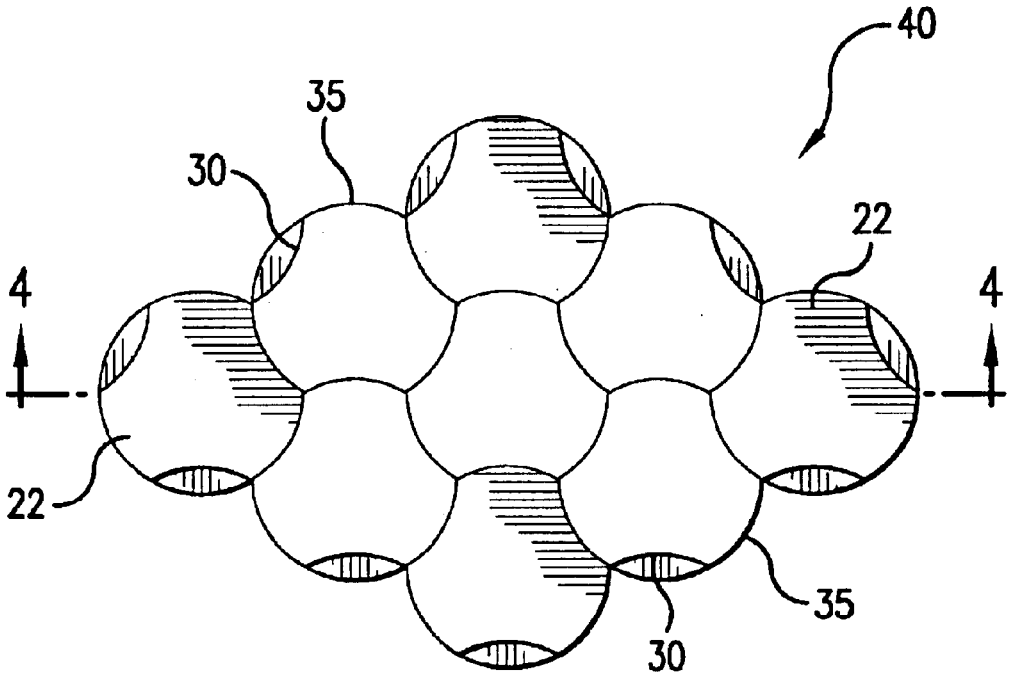
FIG. 3 is a top view of the refractory construction shown in FIG. 2.

In one embodiment of this invention, refractory brick 20 has an overall generally circular periphery, such as shown in the top view of FIG. 9. To provide a tight fit between interlocked refractory bricks 20, radius of curvature 31 of recess 30 is approximately equal to radius of curvature 36 of ridge 35, such as shown in FIG. 9. When radius of curvature 31 is approximately equal to radius of curvature 36, interlocked refractory bricks 20 form relatively tight fits with relatively little gap between interlocked refractory bricks 20, such as shown in FIGS. 3 and 8.

In one embodiment of this invention, recess 30 and ridge 35 have a constant and equal radius along radial direction 28. The constant and equal radii can strengthen and tighten the structure formed by interlocked refractory bricks 20.

In another embodiment of this invention, one or more recesses 30 of one or more refractory bricks 20 has a smaller constant radius that the corresponding or mating ridge 35 and/or has a shape other than a constant radius arc segment. For example, recess 30 can have any other suitable non-circular shape, such as a V-shape, a U-shape or an irregular or random shape. Shapes of recess 30 that are not a constant radius curve can be used to create voids between or within interlocked refractory bricks 20 that can be used to save refractory material, as long as refractory brick 20 remains structurally intact for the intended purpose.

As shown in FIGS. 9 and 10, in one embodiment of this invention, refractory brick 20 has notched area 38 within ridge 35. Notched area 38 is preferably within a particular segment 25 that contains top 22 of refractory brick 20. Notched area 38 provides access to structure of refractory brick 20, for attaching hangers, metalics or other structural members to refractory brick 20, such as for supporting one or more refractory bricks 20.

In one embodiment of this invention, such as shown in FIG. 10, bracket 39 is mounted within notched area 38. Bracket 39 may comprise any suitable metal structural element known to those skilled in the art of refractories.

In one embodiment of this invention, refractory construction 40 comprises at least one course 45 of refractory bricks 20. FIG. 8 shows one course 45 of refractory bricks 20 that form a domed refractory construction 40. Within each course 45, refractory bricks 20 are interlocked with respect to each other. As shown in FIGS. 2, 4, 5 and 6, ridges 35 mate within corresponding recesses 30 to form an interlocked arrangement. In one embodiment, ridge 35 of a first refractory brick 20 and recess 30 of a second refractory brick 20 are of aligned segments 25 of the first refractory brick 20 and the second refractory brick 20.

Figure 12:
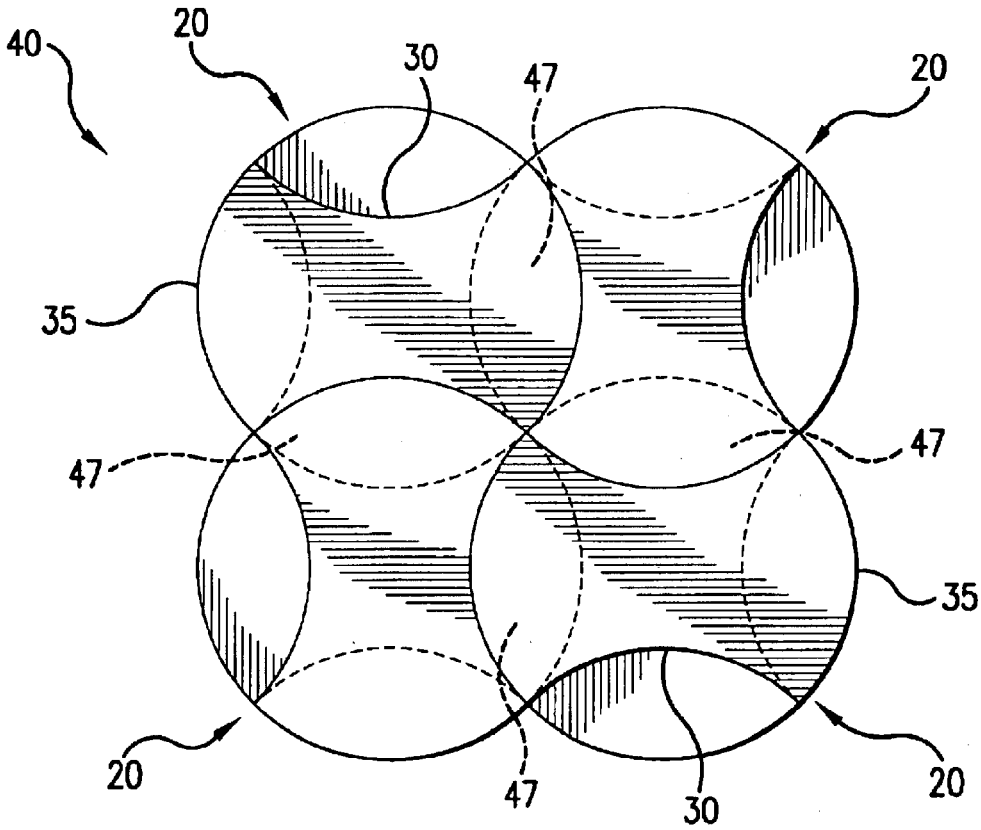
FIG. 12 is a top view of four refractory bricks, each having two arcuate recesses and two ridges, according to one embodiment of this invention.
Figure 13:
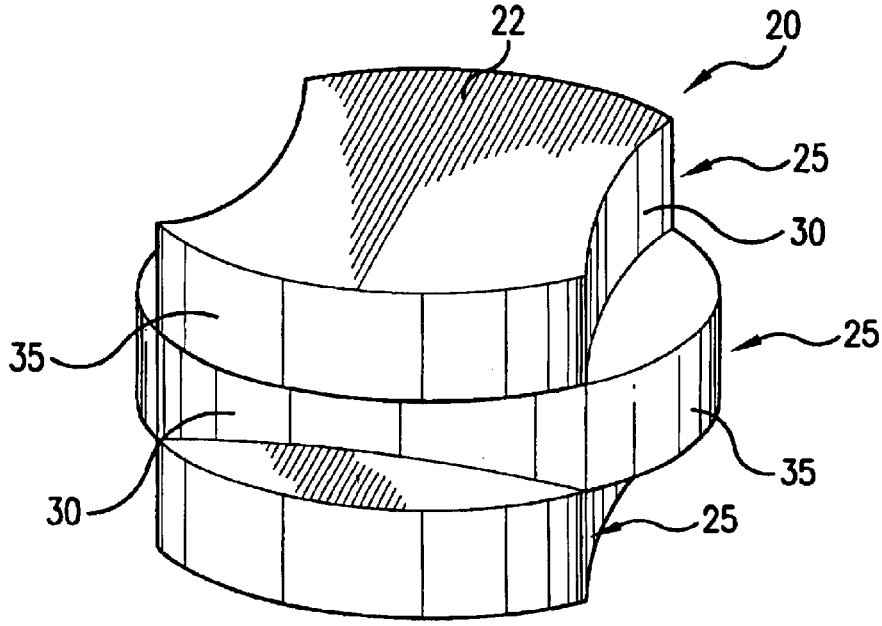
FIG. 13 is a perspective view of one refractory brick as shown in FIG. 12.
Figure 14:
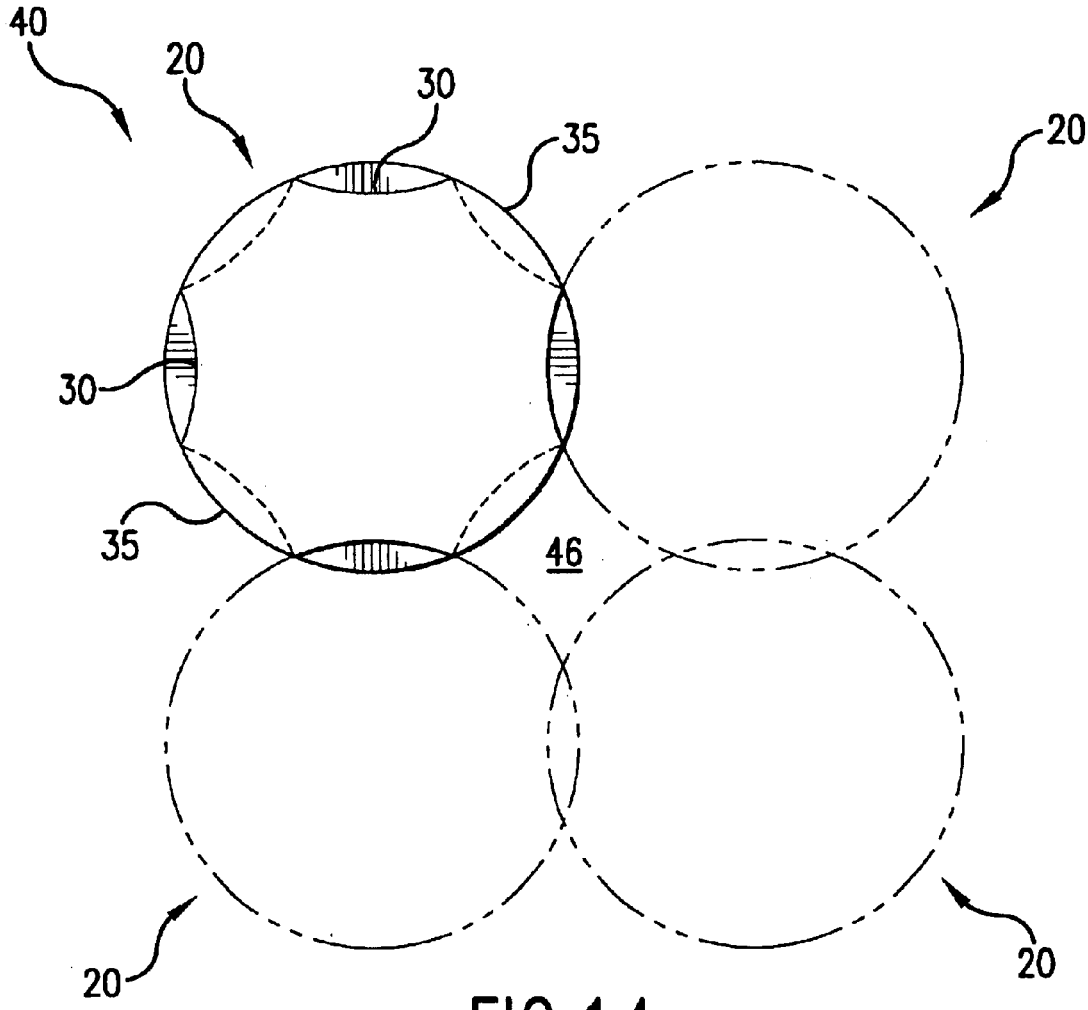
FIG. 14 is a schematic top view of four refractory bricks, each having four arcuate recesses and four ridges, according to one embodiment of this invention.

Refractory brick 20 having a plurality of segments 25, each with three recesses 30 and three ridges 35, provides an efficient refractory construction. As shown in FIGS. 1, 2, 3 and 7, the interlocked refractory bricks 20 have relatively little overlap with respect to each other and form no substantial gaps between refractory bricks 20. FIGS. 12 and 13 show another embodiment of refractory brick 20 having two recesses 30 and two ridges 35. However, as shown in FIG. 12, overlapped regions 47 formed by recesses 30 and ridges 35 are larger than those of refractory brick 20 having three recesses 30 and three ridges 35. As shown in FIG. 14, refractory brick 20 having four recesses 30 and four ridges 35 forms a substantial gap or opening 46 between interlocked refractory bricks 20.

Although refractory bricks 20 having more or less than three recesses 30 and three ridges 35 can provide a structurally sufficient refractory construction 40, refractory bricks 20 having three recesses 30 and three ridges 35 provides a more efficient refractory construction 40, having relatively continuous surfaces formed by tops 22 and bottoms 23 of refractory bricks 20.

Although the drawings show each refractory brick 20 having three segments 25, other embodiments of this invention can have two segments 25 or four or more segments 25. The embodiment having three segments 25 also provides refractory bricks 20 that are easy to handle.

In one embodiment of this invention, such as shown in FIG. 4, sides 24 of refractory brick 20 are at an angle with respect to each other. As shown in FIG. 4, sides 24 are not parallel with respect to each other. Thus, when multiple refractory bricks 20 are positioned next to each other, the overall course 45 of refractory construction 40 is curved, as shown in FIGS. 4 and 8. The angled sides 24 and thus the curved overall structure also provides additional structural support and structural strength of refractory construction 40. In another embodiment of this invention, top 22 and/or bottom 23 of refractory brick 20 can be curved in two dimensions or in three dimensions. Such curved surfaces can better accommodate, for example, a curved head of a vessel.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

What is claimed is:

1. A refractory construction comprising:

a plurality of refractory bricks each having a plurality of segments positioned along a longitudinal axis of the refractory brick, each said segment having at least two arcuate recesses, and said recesses of a first segment of said segments positioned at a radial offset with respect to said recesses of a second segment of said segments, each said segment having an arcuate ridge between two said recesses, said refractory bricks each having opposing sides positioned at an angle with respect to each other, and the refractory bricks interlocked to form a domed construction.

2. The refractory construction according to claim 1, wherein one said arcuate ridge of one said segment has a notched area.

3. The refractory construction according to claim 1, wherein said arcuate ridge is concave outward with respect to said longitudinal axis.

4. The refractory construction according to claim 1, wherein each said recess is concave inward with respect to said longitudinal axis.

5. The refractory construction according to claim 1, wherein each said segment has three said recesses radially spaced apart by approximately 120°.

6. The refractory construction according to claim 5, wherein said radial offset is approximately 60°.

7. The refractory construction according to claim 1, wherein said recesses are approximately evenly spaced in a radial direction.

8. The refractory construction according to claim 1, wherein each said refractory brick has three said segments which are adjacent to each other.

9. The refractory construction according to claim 1, wherein said segments are layered.

10. The refractory construction according to claim 1, wherein said segments are integrated with each other.

11. A refractory construction comprising:

a plurality of refractory bricks each having a plurality of segments positioned along a longitudinal axis of the refractory brick, each said segment having at least two arcuate recesses, and said recesses of a first segment of said segments positioned at a radial offset with respect to said recesses of a second segment of said segments, said refractory brick having an overall generally circular periphery, said ridges from two adjacent said segments forming said overall generally circular periphery, said refractory bricks each having opposing sides positioned at an angle with respect to each other, and the refractory bricks interlocked to form a domed construction.

12. A refectory construction comprising:

a plurality of refractory bricks each having three segments positioned along a longitudinal axis of the refractory brick, each said segment having at least two arcuate recesses, and said recesses of a first segment of said segments positioned at a radial offset with respect to said recesses of a second segment of said segments, each said segment having an arcuate ridge between adjacent said recesses, said refractory bricks each having opposing sides positioned at an angle with respect to each other, the refractory brick having an overall generally circular periphery, a radius of curvature of one said recess equal to a radius of said generally circular periphery; and the refractory bricks interlocked to form a domed construction.

13. A refractory construction comprising:

at least one course each having a plurality of refractory bricks, within each said course said refractory bricks interlocked with respect to each other, each refractory brick of said refractory bricks having a plurality of segments, each said segment having at least three arcuate recesses, and said recesses of a first segment of said segments positioned at a radial offset with respect to said recesses of a second segment of said segments, each said segment having an arcuate ridge between adjacent said recesses, said refractory bricks each having opposing sides positioned at an angle with respect to each other, and the at least one course forming a domed construction.

14. The refractory construction according to claim 13, wherein each said recess is concave inward with respect to a longitudinal axis of a corresponding said refractory brick.

15. The refractory construction according to claim 13, wherein said arcuate ridge is concave outward with respect to a longitudinal axis of a corresponding said refractory brick.

16. The refractory construction according to claim 13, wherein said arcuate ridge of a first refractory brick of said refractory bricks mates within a corresponding said recess of a second refractory brick of said refractory bricks.

17. The refractory construction according to claim 16, wherein said arcuate ridge of said first refractory brick and said recess of said second refractory brick are of aligned said segments of said first refractory brick and said second refractory brick.

18. The refractory construction according to claim 13, wherein each said segment has three said recesses radially spaced apart by approximately 120°.

19. The refractory construction according to claim 13, wherein said radial offset is approximately 60°.

20. The refractory construction according to claim 16, wherein said refractory bricks have three said segments.

21. The refractory construction according to claim 13, wherein in each said segment said recesses are approximately evenly spaced in a radial direction.

22. The refractory construction according to claim 13, wherein each said refractory brick has an overall generally circular periphery.

23. The refractory construction according to claim 13, wherein said at least three segments are integrated with each other.

24. A refractory construction comprising:

at least one course each having a plurality of refractory bricks, within each said course said refractory bricks interlocked with respect to each other, each refractory brick of said refractory bricks having a plurality of segments, each said segment having at least three arcuate recesses, and said recesses of a first segment of said segments positioned at a radial offset with respect to said recesses of a second segment of said segments, each said segment having an arcuate ridge between adjacent said recesses, each said refractory brick having an overall generally circular periphery, a radius of curvature of one said recess equal to a radius of said generally circular periphery, said refractory bricks each having opposing sides positioned at an angle with respect to each other, and the refractory bricks interlocked to form a domed construction.

* * * * *